United States Patent [19]

Yoshimura et al.

[11] Patent Number: 4,935,057

[45] Date of Patent: Jun. 19, 1990

[54] CERMET AND PROCESS OF PRODUCING SAME

[75] Inventors: Hironori Yoshimura; Niro Odani, both of Tokyo, Japan

[73] Assignee: Mitsubishi Metal Corporation, Tokyo, Japan

[21] Appl. No.: 405,523

[22] Filed: Sep. 11, 1989

[51] Int. Cl.[5] ..... C22C 29/04

[52] U.S. Cl. ..... 75/238; 75/244; 419/15; 419/16; 419/33; 419/38

[58] Field of Search ..... 75/238, 244; 419/33, 419/38, 13, 15, 16

[56] References Cited

U.S. PATENT DOCUMENTS

| | | | |
|---|---|---|---|
| 4,046,517 | 9/1977 | Soga | 428/539.9 |
| 4,587,095 | 5/1986 | Yoshimura et al. | 419/13 |
| 4,769,070 | 9/1988 | Tobioka et al. | 75/238 |

FOREIGN PATENT DOCUMENTS

| | | |
|---|---|---|
| 56-27587 | 6/1981 | Japan . |
| 62-79904 | 4/1987 | Japan . |

OTHER PUBLICATIONS

Proceedings of the 10th Plansee-Seminar 1981, pp. 727-741.

*Primary Examiner*—Stephen J. Lechert, Jr.
*Assistant Examiner*—Leon Nigohosian
*Attorney, Agent, or Firm*—Scully, Scott, Murphy & Presser

[57] ABSTRACT

A cermet has a hard phase and a binder phase. The hard phase is formed by about 70% to about 95% by weight of elements including titanium, tantalum, tungsten, carbon and nitrogen. The elements have atomic ratios so as to satisfy the relationships of $0.05 \leqq b/(b+a) \leqq 0.20$, $0.04 \leqq c/(c+a) \leqq 0.20$ and $0.15 \leqq y/(x+y) \leqq 0.60$, where a, b, c, x and y denote atomic ratios of titanium, tantalum, tungsten, carbon and nitrogen, respectively. The binder phase is formed by about 5% to about 30% by weight of at least one metal of cobalt and nickel. Additionally, there is disclosed a process for producing such a cermet.

8 Claims, No Drawings

CERMET AND PROCESS OF PRODUCING SAME

BACKGROUND OF THE INVENTION

1. Field of the Invention

The present invention pertains to a cermet suitably used for manufacturing cutting tools used in interrupted cutting operations such as milling operations.

2. Prior Art

The cermet was the material for cutting tools developed by Ford Motors Company in 1959, and had a composition of TiC-Ni-Mo($Mo_2C$). The discovery of the Ford Motors Company was that the addition of molybdenum (Mo) or molybdenum carbide ($Mo_2C$) improved the degree of sintering and the alloy structure of TiC-Ni cermet to thereby enhance its strength. A further improved cermet which includes titanium nitride (TiN) has been developed nowadays, but the addition of molybdenum or molybdenum carbide has still been considered to be indispensable.

One of the inventors has presented his report entitled "THE REACTION OCCURRING DURING SINTERING AND CHARACTERISTICS OF TiC-20%TiN-15%WC-10%TaC-9%Mo-5.5%Ni-11%Co CERMET" at 10th Planesee Seminar (June 1st to 5th, 1981, Routte, Austria). Japanese Patent Laid-Open (18-Months Publication) No. 50-102508 and U.S. Pat. No. 4,046,517 describe the above TiC-TiN-WC-TaC-Mo-Co cermet. The TiC-TiN-WC-TaC-Mo-Co cermet exhibits superior wear resistance in turning operation of steel, but is susceptible to fracturing during interrupted cutting operations such as milling operations.

Therefore, the inventors have made a further study and found that a cermet free of molybdenum or molybdenum carbide is less susceptible to fracturing, as disclosed in Japanese Patent Application Laid-Open No. 60-221547. However, even such a cermet is still insufficient in toughness when used as cutting tools for interrupted cutting operations.

SUMMARY OF THE INVENTION

It is therefore an object of the present invention to provide a cermet which is less susceptible to fracturing even in interrupted cutting operations such as milling operations, to thereby achieve a prolonged tool life.

Another object of the invention is to provide a process for producing such a cermet.

According to a first aspect to the present invention, there is provided a cermet consisting of a hard phase of about 70% to about 95% by weight of elements consisting essentially of titanium (Ti), tantalum (Ta), tungsten (W), carbon (C) and nitrogen (N) and having atomic ratios so as to satisfy the relationships of $0.05 \leqq b/(b+a) \leqq 0.20$, $0.04 \leqq c/(c+a) \leqq 0.20$ and $0.15 \leqq y/(x+y) \leqq 0.60$, where a, b, c, x and y denote atomic ratios of titanium, tantalum, tungsten, carbon and nitrogen, respectively, and a binder phase of about 5% to about 30% by weight of at least one metal selected from the group consisting of cobalt (Co) and nickel (Ni).

According to a second aspect of the invention, there is provided a process of producing a cermet, comprising the steps of (a) preparing a first powder for forming a core structure for a hard phase of the cermet, preparing second powders for forming a surrounding structure for the hard phase, and preparing a third powder for forming a binder phase for the cermet; (b) grinding the first powder for a prescribed period of time; (c) subsequently adding the second and third powders to the ground first powder to provide a blended powder and subjecting the blended powder to blending for a prescribed period of time to form a powder mixture having a prescribed composition; (d) subsequently compacting the powder mixture into a green compact; and (e) subsequently sintering the green compact under a prescribed sintering condition to form the cermet.

In the foregoing, the first powder is formed of at least one compound selected from the group consisting of TiC, (Ti,Ta)C, TiCN, and (Ti,Ta)(C,N), the second powders consisting of powders of TiN, TaC and WC, the third powder being at least one of the powders of cobalt and nickel.

Furthermore, the tantalum in an amount of no greater than 30 atomic percent by weight may be replaced by niobium. In this case, (Ti,Ta,Nb)C or (Ti,Ta,Nb)(C,N) may be used as starting powder materials for forming the core structure for the hard phase of the cermet.

DESCRIPTION OF THE INVENTION

The inventors have made a further extensive study over the improvement of the prior art cermet and have obtained a cermet in accordance with the present invention which consists of a hard phase of about 70% to about 95% by weight of elements consisting essentially of titanium, tantalum, tungsten, carbon and nitrogen and having atomic ratios so as to satisfy the relationships of $0.05 \leqq b/(b+a) \leqq 0.20$, $0.04 \leqq c/(c+a) \leqq 0.20$ and $0.15 \leqq y/(x+y) \leqq 0.60$, where a, b, c, x and y denote atomic ratios of titanium, tantalum, tungsten, carbon and nitrogen, respectively, and a binder phase of about 5% to about 30% by weight of at least one metal selected from the group consisting of cobalt and nickel.

In the foregoing, if the amount of the elements in the hard phase is below about 70% by weight of the cermet, the resulting cermet becomes inferior in wear resistance. On the other hand, if the amount of the hard phase exceeds about 95% by weight of the cermet, the cermet becomes inferior in toughness, thereby being susceptible to fracturing during interrupted cutting operations. The range of the amount of the metal used for the binder phase should be determined so as to balance the amount of the above hard phase to achieve the prescribed proportion of the hard phase. Thus, the amount of the metal in the binder phase is so determined as to be no less than about 5% by weight of the cermet in order to maintain sufficient toughness and to be no greater than about 30% by weight in order to maintain high wear resistance.

As shown in Table 1, tantalum carbide (TaC) has a higher strength, a lower Young's modulus, and a smaller coefficient of thermal expansion than titanium carbide (TiC), so that it has a higher coefficient of thermal shock which is calculated using the above data. Accordingly, tantalum improves the thermal shock resistance in the interrupted cutting operations such as milling operations. In addition, tantalum is effective in improving the strength of titanium carbide since it forms a solid-solution therewith. However, if the amount of tantalum carbide is excessive, the wear resistance of the resulting cermet is reduced. In view of these facts, the atomic ratio of the tantalum should be selected so as to satisfy the relationship of $0.05 \leqq b/(b+a) \leqq 0.20$ where a and b denote atomic ratios of titanium and tantalum, respectively.

TABLE 1

| | TiC | TaC |
|---|---|---|
| Strength ($Kg/mm^2$) | 6.5 | 8.0 |
| Thermal conductivity (W/cm. °C.) | 0.05 | 0.05 |
| Young modulus ($10^4$ $Kg/mm^2$) | 3.2 | 2.9 |
| Coefficient of thermal expansion ($10^{-6}$/°C.) | 7.4 | 6.3 |
| Coefficient of thermal shock | 1.4 | 2.2 |

Furthermore, in order to improve the strength of the cermet, tungsten is present in the hard phase in such an amount that the atomic ratios of tungsten and titanium satisfy the relationship of $0.04 \leqq c/(c+a) \leqq 0.20$ where a and c denote atomic ratios of titanium and tungsten. If the above ratio $c/(c+a)$ is no greater than 0.04, the toughness is insufficient, while if the ratio $c/(c+a)$ exceeds 0.20, the wear resistance is unduly decreased. In addition, nitrogen serves to inhibit the grain growth of the cermet to improve the strength, and hence is added in the cermet of the invention. However, the amount to be present in the cermet should be within a range which satisfies the relationship of $0.15 \leqq y/(x+y) \leqq 0.60$ where x and y denote atomic ratios of carbon and nitrogen, respectively. If the ratio $y/(x+y)$ is no greater than 0.15, the cermet is subjected to grain growth, thereby deteriorating the toughness. On the other hand, if the ratio exceeds 0.60, pores tend to be formed in the cermet, so that the toughness is reduced.

In the cermet as described above, the hard phase is comprised of a core structure and a surrounding structure around the core structure. The inventors have found that when the cermet is formed so that the tungsten is not present in the core structure but substantially in the surrounding structure, the resulting cermet particularly exhibits a very high toughness.

Furthermore, in the cermet in accordance with the present invention, the tantalum in the hard phase in an amount of no greater than 30 atomic percent by weight may be replaced by niobium although the atomic ratios of tantalum and niobium should be selected so as to satisfy the relationship of $0.05 \leqq (b+d)/(b+d+a) \leqq 0.20$ where d denotes the atomic ratio of niobium.

For producing the cermet in accordance with the present invention, a powder metallurgical process is utilized. Specifically, material powders are first prepared and blended in a prescribed composition, and the blended material is dried and compacted into a green compact, which is then subjected to sintering at a temperature between 1400° C. and 1500° C. within a vacuum atmosphere or a reduced pressure atmosphere of nitrogen gas.

However, in the process of the manufacture of the cermet of the invention, the powder material used for producing the core structure of the hard phase is the compound or solid solution which does not contain tungsten therein. Powders of TiC, (Ti,Ta)C, (Ti,Ta,Nb)C, TiCN, (Ti,Ta)(C,N), (Ti,Ta,Nb)(C,N) are each used as such material. If the powder material of solid solution containing tungsten such as (Ti,W)C, (Ti,W)(C,N), (Ti,Ta,W)(C,N), (Ti,Ta,Nb,W)(C,N) is used, such a material would form the core structure of the hard phase, so that the cermet becomes inferior in wear resistance.

The above powder material for producing the core structure should be preferably used in the form of coarse particles having an average particle size of no less than about 5 μm. Furthermore, amongst the above material, the coarse powder of TiC, (Ti,Ta)C or (Ti,Ta,Nb)C is the most preferable since it contains no nitrogen. Tantalum may be added in the form of a solid solution as described above, or may be added in the form of tantalum carbide. The tungsten has superior wettability with the binder phase, and hence should be present in the surrounding structure. It should be added in the form of tungsten carbide.

The invention will be now be described in detail with reference to the following example.

EXAMPLE

There were prepared powders of TiC (average particle size: 12 μm), (Ti,Ta)C (15 μm), (Ti,Ta,Nb)C (18 μm), TiCN (10 μm), (Ti,Ta)(C,N) (12 μm), and (Ti,Ta,Nb)(C,N) (13 μm) for forming core structures of hard phases of cermets, powders of TiN (1.2 μm), TaC (1.0 μm), NbC (1.5 μm), WC (0.8 μm) and $Mo_2C$ (1.0 μm) for forming surrounding structures of the hard phases, and powders of Co (1.2 μm) and Ni (1.8 μm) for forming binder phases.

The powders of TiC, (Ti,Ta)C, (Ti,Ta,Nb)C, TiCN, (Ti,Ta)(C,N), and (Ti,Ta,Nb)(C,N) were selectively used as starting materials for forming the core structures, and were ground in a ball mill for 12 hours. Then, the other powders for forming the surrounding structures of the hard phases and the binder phases were selectively added were subjected to wet blending in the ball mill for 36 hours. Tables 2 and 5 show the blend composition in each mixture. After being dried, the mixture was subjected to compacting at a pressure of 15 $Kg/mm^2$ to form a green compact. Subsequently, the green compact was sintered under prescribed sintering conditions as shown in Tables 3 and 6 to produce each of cermets 1 to 11 according to the present invention and comparative cermets 1 to 7 which did not fall within the scope of the invention.

For further comparison purposes, powders of TiC (average particle size: 1.5 μm), (Ti,W)C (1.3 μm), (Ti,W)(C,N) (1.1 μm), (Ti,Ta,W)(C,N) (1.4 μm) were prepared as starting materials for forming core structures, and were selectively used together with the other powders for forming the surrounding structures of the cermet and the binder phases. All the powders were subjected to wet blending in a ball mill for 48 hours, and sintered in a similar manner to produce prior art cermets 8 to 11. Tables 5 and 6 show the compositions of the blended mixtures and sintered bodies of the prior art cermets.

Thereafter, the cermets 1 to 11 of this invention, the comparative cermets 1 to 7 and the prior art cermets 8 to 11 were all formed into an ISO, SNG120408 shape to provide cutting inserts (blade members) 1 to 11 of this invention, comparative cutting inserts 1 to 7 and prior art cutting inserts 8 to 11.

As to the cutting inserts 1 to 11 of this invention, comparative cutting inserts 1 to 7 and prior art cutting inserts 8 to 11, the amounts of tungsten present in the core and surrounding structures were measured by E.P.M.A. (electron probe microanalysis), respectively. The results are set forth in Tables 4 and 7.

As seen from Tables 4 and 7, tungsten is not substantially present in the core structures of the cermet inserts 1 to 11 of the invention and the comparative inserts 1 to 7 when an error within 1.0 atomic percent is considered in the measurement by E.P.M.A. In contrast, in the surrounding structures of both kinds of inserts, tungsten is certainly present. On the other hand, in all of the prior art cutting inserts 8 to 11, tungsten is present in the core structures.

Furthermore, the cutting inserts 1 to 11 of this invention, comparative cutting inserts 1 to 7 and prior art cutting inserts 8 to 11 were subjected to a milling test (first cutting test) to determine wear resistance. In the milling test, the flank wear was observed. The conditions for this test were as follows:

Workpiece: mild alloy steel (JIS.SCM415; Hardness: HB160)

Cutting speed: 200 m/minute

Feed rate: 0.25 mm/revolution

Depth of cut: 1.0 mm

Cutting time: 40 minutes

Also, the inserts 1 to 11 of this invention, the comparative inserts 1 to 7 and the prior art inserts 8 to 11 were subjected to another milling test (second cutting test) to determine toughness. In this test, it was determined how many inserts out of ten were subjected to fracturing. The conditions for this test were as follows:

Workpiece: refined steel (JIS.SNCM439; Hardness: HB230)

Cutting speed: 180 m/minute

Feed rate: 0.35 mm/revolution

Depth of cut: 3.0 mm

Cutting time: 20 minutes

The results of the above two tests are also shown in Tables 4 and 7.

As clearly seen from Table 4, the inserts 1 to 11 of this invention exhibited excellent cutting performance. On the other hand, the prior art inserts 8 to 11 as well as the comparative inserts 1 to 7 were inferior in the above property.

TABLE 2

| | | Blend composition Method of addition of Ti to core structure | (% by weight) TiN | TaC | NbC | WC | $Mo_2C$ | Co | Ni |
|---|---|---|---|---|---|---|---|---|---|
| Inserts of the invention | 1 | TiC: 45 | 12 | 13 | — | 12 | — | 14 | 4 |
| | 2 | TiC: 31 | 18 | 16 | — | 17 | — | 14 | 4 |
| | 3 | (Ti,Ta)C: 28 (TiC/TaC = 94/6) | 19 | 15 | 2 | 18 | — | 14 | 4 |
| | 4 | (Ti,Ta,Nb)C: 34 (TiC/TaC/NbC=80/12/8) | 17 | 21 | — | 10 | — | 14 | 4 |
| | 5 | (Ti,Ta)C: 30 (TiC/TaC=80/20) | 20 | 17 | — | 15 | — | 14 | 4 |
| | 6 | TiCN: 38 (TiC/TiN=50/50) | 17 | 12 | — | 15 | — | 14 | 4 |
| | 7 | TiCN: 35 (TiC/TiN=55/45) | — | 16 | 2 | 29 | — | 14 | 4 |
| | 8 | (Ti,Ta,Nb)(CN): 59 (TiC/TiN/TaC/NbC=38/44/14/4) | — | 7 | — | 16 | — | 14 | 4 |
| | 9 | (Ti,Ta)(CN): 67 (TiC/TiN/TaC=48/34/18) | — | — | — | 15 | — | 14 | 4 |
| | 10 | (Ti,Ta)C: 44 (TiC/TaC=74/26) | 19 | 2 | — | 17 | — | 14 | 4 |
| | 11 | (Ti,Ta,Nb)C: 45 (TiC/TaC/NbC = 63/33/4) | 19 | — | — | 18 | — | 14 | 4 |

TABLE 3

| | | Sintering conditions Pressure (Torr) | Temperature (°C.) | Time (Hr) | Composition of sintered body Component ratio in hard phase (Atomic ratio) a | b | d | c | z# | x | Y | (b + d)/(b + d + a) | c/(c + a) |
|---|---|---|---|---|---|---|---|---|---|---|---|---|---|
| Inserts of the invention | 1 | $10^{-2}$ Vacuum | 1450 | 1 | 0.45 | 0.03 | — | 0.02 | — | 0.42 | 0.08 | 0.06 | 0.04 |
| | 2 | $10^{-1}$ Vacuum | 1450 | 1 | 0.42 | 0.04 | — | 0.04 | — | 0.37 | 0.13 | 0.09 | 0.09 |
| | 3 | $10^{-1}$ Vacuum | 1450 | 1 | 0.39 | 0.05 | 0.01 | 0.05 | — | 0.35 | 0.15 | 0.13 | 0.11 |
| | 4 | $10^{-1}$ Vacuum | 1450 | 1 | 0.39 | 0.07 | 0.01 | 0.03 | — | 0.37 | 0.13 | 0.17 | 0.07 |
| | 5 | $10^{-1}$ Vacuum | 1450 | 1 | 0.40 | 0.06 | — | 0.04 | — | 0.35 | 0.15 | 0.13 | 0.09 |
| | 6 | 1 $N_2$ | 1470 | 1 | 0.43 | 0.03 | — | 0.04 | — | 0.23 | 0.27 | 0.07 | 0.09 |
| | 7 | $10^{-1}$ Vacuum | 1450 | 1 | 0.35 | 0.05 | 0.01 | 0.09 | — | 0.36 | 0.14 | 0.15 | 0.20 |
| | 8 | $10^{-1}$ Vacuum | 1450 | 1 | 0.41 | 0.04 | 0.01 | 0.04 | — | 0.30 | 0.20 | 0.11 | 0.09 |
| | 9 | $10^{-1}$ Vacuum | 1450 | 1 | 0.43 | 0.03 | — | 0.04 | — | 0.34 | 0.16 | 0.07 | 0.09 |
| | 10 | $10^{-1}$ Vacuum | 1450 | 1 | 0.43 | 0.03 | — | 0.04 | — | 0.37 | 0.13 | 0.07 | 0.09 |
| | 11 | $10^{-1}$ Vacuum | 1450 | 1 | 0.40 | 0.04 | 0.01 | 0.05 | — | 0.36 | 0.14 | 0.11 | 0.11 |

#denoting atomic ratio of Mo

TABLE 4

| | | Amount of W in hard phase: Core structure (Atomic %) | Surrounding structure (Atomic %) | Cutting test: 1st test Flank wear (mm) | 2nd test Fractured inserts/tested inserts |
|---|---|---|---|---|---|
| Inserts of this invention | 1 | 0.2 | 2.8 | 0.20 | 3/10 |
| | 2 | 0.4 | 4.7 | 0.15 | 0/10 |
| | 3 | 0.4 | 6.0 | 0.15 | 0/10 |
| | 4 | 0.2 | 3.6 | 0.22 | 1/10 |
| | 5 | 0.3 | 4.8 | 0.18 | 0/10 |

TABLE 4-continued

| | | Amount of W in hard phase | | Cutting test | |
|---|---|---|---|---|---|
| | | Core structure (Atomic %) | Surrounding structure (Atomic %) | 1st test Flank wear (mm) | 2nd test Fractured inserts/ tested inserts |
| | 6 | 0.3 | 4.9 | 0.19 | 2/10 |
| | 7 | 0.4 | 10.4 | 0.24 | 1/10 |
| | 8 | 0.3 | 4.8 | 0.17 | 0/10 |
| | 9 | 0.2 | 4.8 | 0.16 | 0/10 |
| | 10 | 0.3 | 5.0 | 0.15 | 0/10 |
| | 11 | 0.3 | 6.3 | 0.15 | 0/10 |

TABLE 5

| | | Blend composition Method of addition of Ti to core structure | (% by weight) TiN | TaC | NbC | WC | $Mo_2C$ | Co | Ni |
|---|---|---|---|---|---|---|---|---|---|
| Comparative inserts | 1 | TiC: 47 | 11 | 8 | — | 16 | — | 14 | 4 |
| | 2 | TiC: 25 | 12 | 34 | — | 11 | — | 14 | 4 |
| | 3 | TiC: 44 | 12 | 17 | 2 | 7 | — | 14 | 4 |
| | 4 | TiCN: 30 (TiC/TiN = 55/45) | — | 16 | 2 | 34 | — | 14 | 4 |
| | 5 | TiC: 50 | 7 | 13 | — | 12 | — | 14 | 4 |
| | 6 | TiC: 9 | 48 | 13 | — | 12 | — | 14 | 4 |
| | 7 | TiC: 24 | 19 | 13 | 6 | 20 | — | 14 | 4 |
| Prior art inserts | 8 | *TiC: 25 | 21 | 10 | — | 17 | *10 | 11 | 6 |
| | 9 | *(Ti,W)C: 50 (TiC/WC = 65/35) | 17 | 15 | — | — | — | 14 | 4 |
| | 10 | *(Ti,W) (C,N): 67 (TiC/TiN/WC = 47/29/24) | — | 15 | — | — | — | 14 | 4 |
| | 11 | *(Ti,Ta,W) (C,N): 82 (TiC/TiN/TaC/WC = 39/23/19/19) | — | — | — | — | — | 14 | 4 |

*not falling within the range of this invention

TABLE 6

| | | uz,6/24 Sintering conditions Pressure (Torr) | Temperature (°C.) | Time (Hr) | Composition of sintered body Component ratio in hard phase (Atomic ratio) a | b | d | c | z# | x | y | b + d / b + d + a | c / c + a |
|---|---|---|---|---|---|---|---|---|---|---|---|---|---|
| Comparative inserts | 1 | $10^{-2}$ Vacuum | 1450 | 1 | 0.44 | 0.02 | — | 0.04 | — | 0.43 | 0.07 | *0.04 | 0.08 |
| | 2 | $10^{-2}$ Vacuum | 1450 | 1 | 0.37 | 0.10 | — | 0.03 | — | 0.40 | 0.10 | *0.21 | 0.08 |
| | 3 | $10^{-2}$ Vacuum | 1450 | 1 | 0.44 | 0.04 | 0.01 | 0.01 | — | 0.42 | 0.08 | 0.10 | *0.02 |
| | 4 | $10^{-2}$ Vacuum | 1450 | 1 | 0.33 | 0.05 | 0.01 | 0.11 | — | 0.38 | 0.12 | 0.15 | *0.25 |
| | 5 | $10^{-2}$ Vacuum | 1450 | 1 | 0.44 | 0.03 | — | 0.03 | — | 0.46 | *0.04 | 0.06 | 0.06 |
| | 6 | 1 $N_2$ | 1470 | 1 | 0.44 | 0.03 | — | 0.03 | — | 0.18 | *0.32 | 0.06 | 0.06 |
| | 7 | $10^{-1}$ Vacuum | 1450 | 1 | 0.38 | 0.04 | *0.03 | 0.05 | — | 0.36 | 0.14 | 0.16 | 0.12 |
| Prior art inserts | 8 | $10^{-1}$ Vacuum | 1450 | 1 | 0.38 | 0.03 | — | 0.04 | *0.05 | 0.35 | 0.15 | 0.07 | 0.10 |
| | 9 | $10^{-1}$ Vacuum | 1450 | 1 | 0.42 | 0.04 | — | 0.04 | — | 0.36 | 0.14 | 0.09 | 0.09 |
| | 10 | $10^{-1}$ Vacuum | 1450 | 1 | 0.42 | 0.04 | — | 0.04 | — | 0.36 | 0.14 | 0.09 | 0.09 |
| | 11 | $10^{-1}$ Vacuum | 1450 | 1 | 0.42 | 0.04 | — | 0.04 | — | 0.36 | 0.14 | 0.09 | 0.09 |

#denoting atomic ratio of Mo
*not falling within the range of this invention

TABLE 7

| | | Amount of W in hard phase | | Cutting test | |
|---|---|---|---|---|---|
| | | Core structure (Atomic %) | Surrounding structure (Atomic %) | 1st test Flank wear (mm) | 2nd test Fractured inserts/ tested inserts |
| Comparative inserts | 1 | 0.3 | 5.3 | 0.24 | 9/10 |
| | 2 | 0.2 | 4.0 | 0.49 | 5/10 |
| | 3 | 0.2 | 1.5 | 0.24 | 9/10 |
| | 4 | 0.7 | 11.8 | 0.49 | 7/10 |
| | 5 | 0.2 | 3.8 | 0.26 | 9/10 |
| | 6 | 0.2 | 3.7 | 0.28 | 10/10 |
| | 7 | 0.5 | 5.9 | 0.25 | 5/10 |
| Prior art inserts | 8 | *2.8 | 5.0 | 0.26 | 9/10 |
| | 9 | *8.7 | 1.9 | 0.39 | 8/10 |
| | 10 | *7.6 | 2.0 | 0.37 | 7/10 |
| | 11 | *5.4 | 2.4 | 0.40 | 7/10 |

*not falling within the range of this invention

What is claimed is:

1. A cermet consisting of a hard phase of about 70% to about 95% by weight of elements consisting essentially of titanium, tantalum, tungsten, carbon and nitrogen and having atomic ratios so as to satisfy the relationships of $0.05 \leqq b/(b+a) \leqq 0.20$, $0.04 \leqq c/(c+a) \leqq 0.20$ and $0.15 \leqq y/(x+y) \leqq 0.60$, where a, b, c, x and y denote atomic ratios of titanium, tantalum, tungsten, carbon and nitrogen, respectively, and a binder phase of about 5% to about 30% by weight of at least one metal selected from the group consisting of cobalt and nickel.

2. A cermet according to claim 1, in which said tantalum in an amount of no greater than 30 atomic percent by weight is replaced by niobium.

3. A cermet according to claim 1 or claim 2, in which said hard phase consists of a core structure and a surrounding structure around said core structure, all of the tungsten being present substantially in said surrounding structure.

4. A process of producing a cermet according to claim 1, comprising the steps of:

(a) preparing a first powder for forming a core structure for a hard phase of the cermet, preparing second powders for forming a surrounding structure for the hard phase, and preparing a third powder for forming a binder phase of the cermet, said first powder being formed of at least one compound selected from the group consisting of TiC, (Ti,Ta)C, TiCN, and (Ti,Ta)(C,N), said second powders consisting of powders of TiN, TaC and WC, said third powder being at least one of the powders of cobalt and nickel;

(b) grinding said first powder for a prescribed period of time;

(c) subsequently adding said second and third powders to the ground first powder to provide a blended powder and subjecting said blended powder to blending for a prescribed period of time to form a powder mixture having a prescribed composition;

(d) subsequently compacting said powder mixture into a green compact; and (e) subsequently sintering said green compact under a prescribed sintering condition to form the cermet.

5. A process of producing a cermet according to claim 2, comprising the steps of:

(a) preparing a first powder for forming a core structure for a hard phase of the cermet, preparing second powders for forming a surrounding structure for the hard phase, and a third powder for forming a binder phase of the cermet, said first powder being formed of at least one compound selected from the group consisting of (Ti,Ta,Nb)C and (Ti,Ta,Nb)(C,N), said second powders consisting of powders of TiN, TaC and WC, said third powder being at least one of the powders of cobalt and nickel;

(b) grinding said first powder for a prescribed period of time;

(c) subsequently adding said second and third powders to the ground first powder to provide a blended powder and subjecting said blended powder to blending for a prescribed period of time to form a powder mixture having a prescribed composition;

(d) subsequently compacting said powder mixture into a green compact; and (e) subsequently sintering said green compact under a prescribed sintering condition to form the cermet.

6. A process of producing a cermet according to claim 2, comprising the steps of:

(a) preparing a first powder for forming a core structure for a hard phase of the cermet, preparing second powders for forming a surrounding structure for the hard phase, and preparing a third powder for forming a binder phase of the cermet, said first powder being formed of at least one compound selected from the group consisting of TiC, (Ti,Ta)C, TiCN, and (Ti,Ta)(C,N), said second powders consisting of powders of TiN, NbC, TaC and WC, said third powder being at least one of the powders of cobalt and nickel;

(b) grinding said first powder for a prescribed period of time;

(c) subsequently adding said second and third powders to the ground first powder to provide a blended powder and subjecting said blended powder to blending for a prescribed period of time to form a powder mixture having a prescribed composition;

(d) subsequently compacting said powder mixture into a green compact; and (e) subsequently sintering said green compact under a prescribed sintering condition to form the cermet.

7. A process of producing a cermet according to claim 4, claim 5 or claim 6, in which said first powder is in the form of coarse particles having an average particle size of no less than about 5 μm.

8. A blade member for use in interrupted cutting operation being made of a cermet according to claim 1 or claim 2.

* * * * *